US010092927B2

(12) United States Patent
George et al.

(10) Patent No.: US 10,092,927 B2
(45) Date of Patent: Oct. 9, 2018

(54) MOLECULAR LAYER DEPOSITION PROCESS FOR MAKING ORGANIC OR ORGANIC-INORGANIC POLYMERS

(75) Inventors: Steven M. George, Boulder, CO (US); Arrelaine Allen Dameron, Boulder, CO (US); Nicole Marie Adamczyk Keaner, Madison, WI (US); Byunghoon Yoon, Boulder, CO (US)

(73) Assignee: The Regents of the University of Colorado, a Body Corporate, Denver, CO (US)

( * ) Notice: Subject to any disclaimer, the term of this patent is extended or adjusted under 35 U.S.C. 154(b) by 1713 days.

(21) Appl. No.: 12/513,831

(22) PCT Filed: Nov. 13, 2007

(86) PCT No.: PCT/US2007/023728

§ 371 (c)(1),
(2), (4) Date: Aug. 15, 2011

(87) PCT Pub. No.: WO2008/069894

PCT Pub. Date: Jun. 12, 2008

(65) Prior Publication Data

US 2012/0121932 A1 May 17, 2012

Related U.S. Application Data

(60) Provisional application No. 60/858,756, filed on Nov. 13, 2006.

(51) Int. Cl.
*B05D 1/00* (2006.01)
*B05D 7/00* (2006.01)

(52) U.S. Cl.
CPC . *B05D 1/60* (2013.01); *B05D 7/52* (2013.01)

(58) Field of Classification Search
CPC ..... C23C 16/45555; C23C 16/45525; C23C 16/45527; C23C 16/45529; C23C 16/45531
See application file for complete search history.

(56) References Cited

U.S. PATENT DOCUMENTS 5,444,811 A * 8/1995 Yoshimura et al. ..... 385/141
6,218,250 B1 4/2001 Hause et al.
(Continued)

FOREIGN PATENT DOCUMENTS

WO 03038143 A1 5/2003

OTHER PUBLICATIONS

Jiang (Journal of Colloid and Interface Science 275 (2004) 596-600).*

(Continued)

*Primary Examiner* — Joel G Horning
(74) *Attorney, Agent, or Firm* — Arendt & Associates Intellectual Property Group; Jacqueline Arendt

(57) ABSTRACT

Ultrathin layers of organic polymers or organic-inorganic hybrid polymers are deposited onto a substrate using molecular layer deposition methods. The process uses vapor phase materials which contain a first functional group and react only monofunctionally at the surface to add a unit to the polymer chain. The vapor phase reactant in addition has a second functional group, which is different from the first functional group, or a blocked, masked or protected functional group, or else has a precursor to such a functional group.

4 Claims, 5 Drawing Sheets

(56) References Cited

U.S. PATENT DOCUMENTS

| | | | |
|---|---|---|---|
| 6,613,383 | B1 | 9/2003 | George et al. |
| 2005/0223989 | A1 | 10/2005 | Lee et al. |
| 2005/0271893 | A1 | 12/2005 | Kobrin et al. |

OTHER PUBLICATIONS

George, S.M. et al., "Surface Chemistry for Atomic Layer Growth," J. Physical Chem. 100, pp. 13121-13131, May 8, 1996. Eleven pages.

Ott, A.W. et al., "A1303 thin film growth on Si(100) using binary reaction sequence chemistry," Thin Solid Films 292, pp. 135-144., 1997. Ten pages.

Ritala, M. et al., "Atomic Layer Deposition," in Handbook of Thin Film Materials, vol. 1: Deposition and Processing of Thin Films, Chapter 2, pp. 103-159. H.S. Halway, Ed. San Diego, Calif.: 2002, Academic Press. Fifty-seven pages.

Shao, H. et al., "Layer-by-layer polycondensation of nylon 66 by alternation vapour deposition polymerization," Polymer vol. 38 No. 2, pp. 459-462, 1997. Four pages.

Yoshimura, T. et al., "Polymer films formed with monolayer growth steps by molecular layer deposition," Applied Physics Letters 59, 482, 1991. Four pages.

International Search Report for related case, PCT/US2007/023728, dated Jan. 29, 2009. Four pages.

Ziche, W. et al., "Synthesis and structure of 1,6-diaza-2,2-dimethoxy-2-silacyclooctane," J. Organometallic Chemistry, 521:29-31 (1996).

* cited by examiner

MOLECULAR LAYER DEPOSITION PROCESS FOR MAKING ORGANIC OR ORGANIC-INORGANIC POLYMERS

This application claims benefit of U.S. Provisional Application No. 60/858,756, filed 13 Nov. 2006.

STATEMENT OF GOVERNMENT INTEREST

This invention was made with government support under grant numbers CHE048554 and FA9550-06-1-0075 awared by the National Science Foundation and the U.S. Air Force, respectively. The government has certain rights in the invention.

This invention relates to a method for making organic or organic-inorganic polymers via a molecular layer deposition process.

Atomic layer deposition (ALD) is a method by which ultrathin layers of inorganic materials can be deposited onto a variety of substrates. The layers are produced by sequentially conducting a series of half-reactions at the surface of a substrate. Each set of half-reactions deposits a layer that is about 1 to 5 Ångstroms thick and which conforms to the surface of the underlying substrate. By repeating the reaction sequence, a layer of any desired thickness can be deposited onto the substrate surface.

The ALD process is described generally in a variety of references, including George et al., *J. Physical Chem.* 1996, 100, 13121; Ritala et al., "Atomic Layer Deposition" in *Handbook of Thin Film Materials*, H. S. Halwa, Ed., 2001, Academic. Press, San Diego, Calif., Dillon et al., *Thin Solid Films* 1997, 292, 135, U.S. Pat. Nos. 6,613,383 and 6,218, 250. The process has been shown to be useful to deposit a variety of inorganic materials, such as aluminum oxide, titanium oxide, silica, zirconium oxide, tantalum oxide, various metal nitrides, and certain metals such as tungsten.

There have been attempts to adapt the ALD methods to produce ultra-thin polymer coatings. These methods have been described using terms such as "molecular layer deposition" (MLD), "alternating vapor deposition polymerization" (AVDP) or "layer by layer" (LbL) polymerization. Examples of such processes are described, for example, in Yoshimura et al., Applied Physics Letters, 1991, 59, 482, Shao et al., Polymer 1997, 38, 459, and Kim et al., JACS, 2005, 127, 6123. These processes employ a binary reaction scheme, in which a bifunctional first reactant that takes the form A-X-A is reacted with a bifunctional second reactant, which takes the form B-Y-B. The A-X-A material contains two identical reactive groups (designated as A) linked by a linking group X. The B-Y-B material contains two identical reactive groups (B) linked by a linking group Y.

To date, MLD processes based on bifunctional or higher functional reactants have had limited success. The polymerization reaction may slow considerably or even stop after a few reaction cycles, because the reactants can react with two or more of the growing polymer chains, without producing a new functional group which is available for further reaction. These multiple reactions limit the molecular weight and thickness of the polymer layer. In addition, some problems with MLD processes appear to be related to CVD (chemical vapor deposition) occurring when using bifunctional or higher functional reactants. The reactants tend to have lower vapor pressures than more traditional ALD reactants. This makes it more difficult to purge the reactor between successive doses of the reactants, which leads to CVD-type reactions. CVD-type reactions lead to the formation granular coatings, and also make it difficult to obtain fine control over the coating thickness.

It would therefore be desirable to provide a process by which ultrathin layers of polymeric materials can be prepared.

In one aspect, this invention is a molecular layer deposition process for forming an ultrathin layer of an organic polymer or organic-inorganic polymer onto a substrate, comprising contacting the substrate in sequential and alternating fashion with at least two vapor phase reactants to form a polymer chain, wherein;

a) each vapor phase reactant reacts only monofunctionally with a functional group that is formed on the polymer chain after reaction with a different vapor phase reactant to form a bond to the polymer chain and produce a new functional group or a precursor to a new functional group; and b) the polymer chain is an organic polymer or an organic-inorganic polymer.

This process can be conducted using at least two different reactants, each of which reacts only monofunctionally with the polymer chain. Thus, in simple embodiments, an A-B type polymer is formed, in which the polymer chain contains alternating A and B units, the A units being derived from a first reactant, and the B units being derived from a second reactant. Any greater number of reactants can be used in the process. For example, three reactants can be used to form an A-B-C type polymer, where the A, B and C units are derived from a first, second and third reactant, respectively, and x and y are positive numbers. Four reactants can be used to form polymers such as A-B-C-D types, where the A, B C and D units are derived from the first, second, third and fourth reactants, respectively and x and y are positive numbers. Higher numbers of reactants can be used in analogous manner to form various polymer types.

As used throughout this specification and claims, the term "vapor phase reactant" is a reactant that introduces a repeating unit onto the polymer chain. On the other hand, the term "vapor phase reactant" does not include other reactants such as those which may be used, for example, to convert a functional group precursor or a masked or protected functional group to a functional group, as described in more detail below.

In a particular embodiment, this invention is a molecular layer deposition process for forming an ultrathin layer of an organic polymer or organic-inorganic polymer onto a substrate, comprising contacting the substrate in sequential and alternating fashion with at least a first vapor phase reactant and a second vapor phase reactant to form a polymer chain, wherein;

a) the first vapor phase reactant reacts only monofunctionally with a second functional group on the polymer chain to form a bond to the polymer chain and produce a first functional group or first functional group precursor on the polymer chain;

b) the second vapor phase reactant reacts only monofunctionally with a first functional group to form a bond to the polymer chain and produce a second functional group or functional group precursor on the polymer chain and c) the polymer chain is an organic polymer or an organic-inorganic polymer.

In another aspect, the invention is a molecular layer deposition process for forming an ultrathin layer of an organic polymer or organic-inorganic polymer onto a substrate, comprising a) contacting the substrate with a vapor phase reactant that reacts only monofunctionally with a reactive site on the substrate to form a bond to the substrate and produce a polymer chain having a functional group precursor or a masked or protected functional group, wherein the functional group precursor or masked or protected functional group is not reactive with the vapor phase reactant; then b) converting the functional group precursor or masked or protected functional group to a functional group that is reactive with the vapor phase reactant; and then c) contacting the substrate with an additional quantity of the vapor phase reactant such that the additional quantity of the vapor phase reactant reacts only monofunctionally with the functional group formed in step b) to form a bond to the polymer chain and produce another functional group precursor or masked or protected functional group on the polymer chain and then d) sequentially and alternatingly repeating steps b and c one or more additional times.

In a particular embodiment of this aspect of the invention, polymer alloys can be produced in analogous fashion, using two or more vapor phase reactants, to provide for even higher control of the polymer properties. The polymer alloy can take the form $(A)_a$-$(B)_b$, where, as before, A and B are units derived from each of two vapor phase reactants, and a and b are each at least two. Analogous polymer alloys can be prepared using three or more vapor phase reactants. For example, polymer alloys that can be produced take the form $(A\text{-}B)_x$-$(E\text{-}B)_y$-, where A, B and E are units derived from each of three different vapor phase reactants, and x and y are each at least one, and are preferably each at least two.

A number of special applications are expected for polymer MLD. These applications are anticipated for polymer MLD on substrates such as organic polymer films, silicon wafers, microelectrical mechanical devices, electronic devices and various inorganic or organic polymer particles. Many applications are also expected for nanotechnology for polymer MLD on nanoparticles, nanotubes and nanorods. The polymer MLD may serve a variety of functions such as protection layers, chemical functional layers, hydrophilic or hydrophobic layers, biocompatible layers, protein-resistant layers, low dielectric layers, low refractive index layers, electrically conducting layers, spacer layers, sacrificial layers for subsequent removal to create an air gap or compliant layers.

In certain aspects, this invention is an ultrathin inorganic-organic multilayer copolymer produced using ALD and MLD processes, in which multiple layers of an inorganic material are deposited on the substrate by sequentially exposing the surface to one or more vapor phase reactants and then multiple layers of an organic polymer are deposited on the substrate by sequentially exposing the substrate to one or more different vapor phase reactants.

In another aspect, this invention is a reaction vessel for conducting an MLD reaction, wherein the reaction vessel includes a reaction zone, multiple inlets for separately introducing two or more MLD precursors to the reaction zone, multiple outlets for separately removing excess MLD precursors from the reaction zone, and means for heating the walls of the reaction zone.

A. Molecular Layer Deposition Processes

Figure 1:
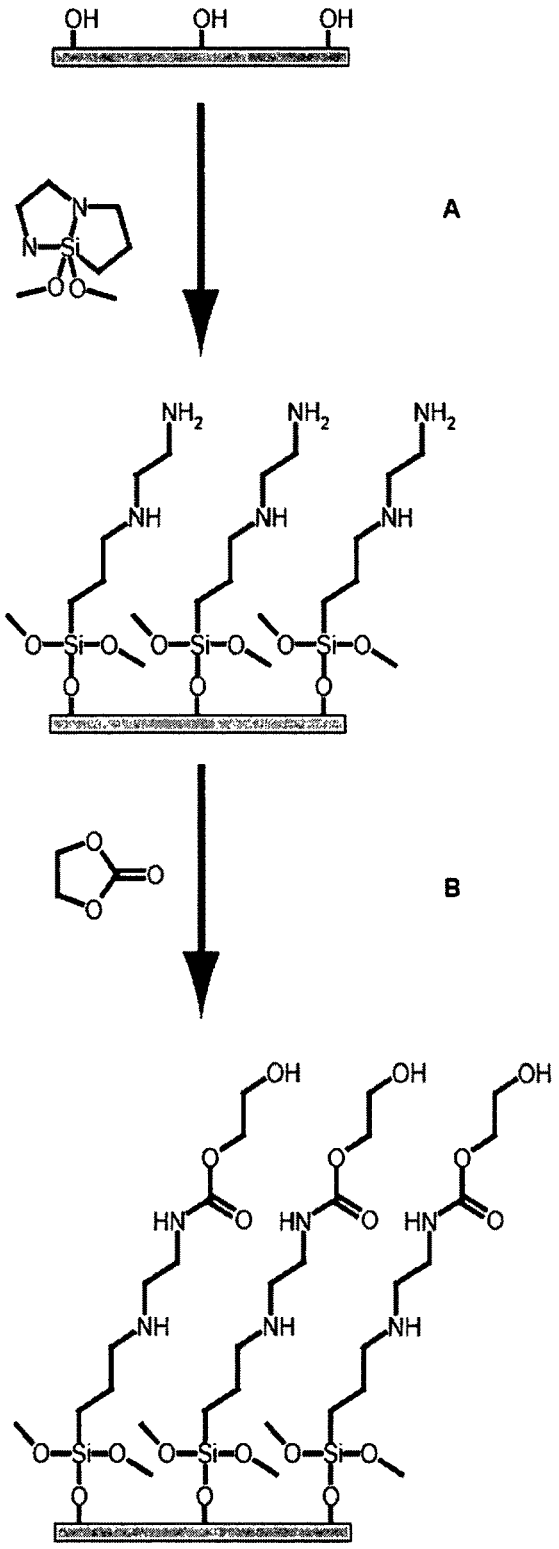
FIG. 1 is a schematic representation of an embodiment of an MLD process of the invention.

According to the invention, organic or organic/inorganic polymers are prepared by a molecular layer deposition process through the exposure of a substrate material to one or more vapor phase precursors.

The molecular layer deposition process is characterized by several features. All reagents are applied in the vapor phase. When multiple reactants are used, the reagents are applied to the substrate sequentially, i.e., one after the other, rather than simultaneously. Excess reagent, if any, is removed from the reaction zone prior to introduction of the next reagent. This is typically done by drawing a high vacuum in the reaction zone after each reactant is dosed into the reactor, and/or by purging the reaction zone with an inert purge gas after each dose of reactant. The removal of excess reagent in this manner prevents reactions from occurring at places other than the surface of the substrate, such as in the vapor phase. Vapor phase reactions are undesirable, as they tend to form polymer particles or droplets that can condense and deposit on the substrate (and reactor surfaces). This condensation can lead to non-uniformity in the thickness of the deposited polymer, as well as other problems, and is to be avoided. Sequential addition of the reagents, together with removal of excess reagent prior to introducing the next reagent into the reaction zone, can minimize or prevent the undesired vapor phase reactions.

All reaction by-products produced in the molecular layer deposition process are preferably gasses or have a vapor pressure of at least 1 millitorr, preferably at least 100 milliTorr and even more preferably at least 1 Torr, at the temperature at which the process is conducted. This facilitates removal of the by-products from the reaction zone and minimizes or prevents the by-products from condensing on the substrate or reactor surfaces. Reaction by-products are removed from the reaction zone prior to the introduction of the next reactant, in the same manner as described above.

The temperature at which the MLD process is conducted depends on the particular reactants and the substrate. The temperature is high enough that, the reagents exhibit a vapor pressure of at least 1 milliTorr, more preferably at least 100 milliTorr and even more preferably at least 1 Torr. The temperature is also high enough that the reactants will react with surface species on the substrate. The temperature must not be so high that the polymer or substrate thermally degrades. The temperature must be below low enough that the substrate does not become distorted in the process. A suitable temperature range can be from 273°K to 1000°K. A preferred temperature range is from 273°K to 500° C. and an even more preferred temperature range is form 300 to 450° C.

The vapor phase reactants used herein are gasses or else have a vapor pressure of at least 1 millitorr at the temperature at which the reaction is conducted. The vapor phase reactants preferably have a vapor pressure of at least 100 milliTorr and more preferably at least 1 Torr at such temperature.

A second characteristic is that the vapor phase reactants can react with a functional group on the surface of the substrate or on the growing polymer chain to form a bond to the substrate or the growing polymer chain, as the case may be. A third characteristic is that upon reacting with the substrate or growing polymer chain, the vapor phase reactants each produce either (1) a functional group (which may be blocked, masked or otherwise protected) with which the other vapor phase reactant can react to grow the polymer chain or (2) a precursor to such a functional group.

In most cases, a fourth characteristic is that the vapor phase reactants react only monofunctionally with the substrate or growing polymer chain, i.e., only one group or moiety on the vapor phase reactant is capable of reacting with the substrate or growing polymer chain under the conditions of the reaction. This prevents unwanted cross-linking or chain termination that can occur when a vapor phase reactant can react polyfunctionally. A reactant is considered to react "monofunctionally" if during the reaction the reactant forms a bond to only one polymer chain, and does not self-polymerize under the reaction conditions employed. As explained more fully below, it is possible in certain embodiments of the invention to use a vapor phase reactant that can react difunctionally with the substrate or growing polymer chain, provided that the vapor phase reactant contains at least one additional functional group. Reactants that have exactly two functional groups which have approximately equal reactivity are preferably avoided in the practice of this invention.

A first class of suitable vapor phase reactants are compounds having two different reactive groups, one of which is reactive with a functional group on the substrate or polymer chain and one of which does not readily react with a functional group on the polymer chain but is reactive with a functional group supplied by a different vapor phase reactant. Examples of reactants of this class include:

a) Hydroxyl compounds having vinyl or allylic unsaturation. These can react with a carboxylic acid, carboxylic acid halide, or siloxane group to form an ester or silicone-oxygen bond and introduce vinyl or allylic unsaturation onto the polymer chain. Alternatively, the unsaturated group can react with a primary amino group in a Michaels reaction to extend the polymer chain and introduce a hydroxyl group onto the chain.

b) Aminoalcohol compounds. The amino group can react with a carboxyl group, a carboxylic acid chloride, a vinyl or allylic group, or an isocyanate group, for example, to extend the polymer chain and introduce a hydroxyl group onto the chain. Alternatively, the hydroxyl group can react with a siloxane species to form a silicon-oxygen bond and introduce a free primary or secondary amino group.

A second class of suitable vapor phase reactants includes various cyclic compounds which can engage in ring-opening reactions. The ring-opening reaction produces a new functional group which does not readily react with the cyclic compound. Examples of such cyclic compounds include, for example:

a) Cyclic azasilanes. These can react with a hydroxyl group to form a silicon-oxygen bond and generate a free primary or secondary amino group.

b) Cyclic carbonates, lactones and lactams. The carbonates can react with a primary or secondary amino group to form a urethane linkage and generate a free hydroxyl group. The lactones and lactams can react with a primary or secondary amino group to form an amide linkage and generate a free hydroxyl or amino group, respectively.

A third class of vapor phase reactants includes compounds that contain two different reactive groups, both of which are reactive with a functional group on the polymer chain, but one of which is much more highly reactive with that functional group. This allows the more reactive of the groups to react with the functional group on the polymer chain while leaving the less reactive group unreacted and available for reaction with another vapor phase reactant.

A fourth class of vapor phase reactants includes compounds that contain two reactive groups, one of which is blocked or otherwise masked or protected such that it is not available for reaction until the blocking, masking or protective group is removed. The blocking or protective group can be removed chemically in some cases, and in other cases by thermally decomposing the blocking group to generate the underlying reactive group, by radiating the group with visible or ultraviolet light, or in a photochemical reaction. The unprotected group may be, for example, an amino group, anhydride group, hydroxyl group, carboxylic acid group, carboxylic anhydride group, carboxylic acid ester group, isocyanate group and the like. The protected group may be one which, after removal of the protective group, gives rise to a functional group of any of the types just mentioned.

A reactant of this fourth class may, for example, have a hydroxyl group protected by a leaving group such as a benzyl, nitrobenzyl, tetrahydropyranyl, $—CH_2OCH_3$ or similar group. In these cases, the hydroxyl group can be deprotected in various ways, for example by treatment with HCl, ethanol, or in some cases, irradiation. Carboxyl groups can be protected with leaving groups such as $—CH_2SCH_3$, t-butyl, benzyl, dimethylamino and similar groups. These groups can be deprotected by treatment with species such as trifluoroacetic acid, formic acid, methanol or water to generate the carboxylic acid group. Amino groups can be protected with groups such as R—OOC—, which can be removed by reaction with trifluoroacetic acid, hydrazine or ammonia. Isocyanate groups can be protected with carboxyl compounds such as formic acid or acetic acid.

A fifth class of vapor phase reactants contains a first functional group, and a precursor group at which a further reaction can be conducted to produce a second functional group. In such a case, the first functional group reacts to bond to the polymer chain, and chemistry is then performed at the precursor group to generate a second functional group. The first functional group can be any of the types mentioned before, including a siloxane group, amino group, anhydride group, hydroxyl group, carboxylic acid group, carboxylic anhydride group, carboxylic acid ester group, isocyanate group and the like. A wide variety of precursor groups can be present on this type of reactant.

The precursor group is one that it does not itself react with the polymer chain, but it can be converted to a functional group that can react with another vapor phase reactant to grow the chain. Two notable types of precursor groups are vinyl and/or allylic unsaturation, and halogen substitution, especially chlorine or bromine. Vinyl and allylic unsaturation can be converted to functional groups using a variety of chemistries. These can react with ozone or peroxides to form carboxylic acids or aldehydes. They can also react with ammonia or primary amino to produce an amine or imine. Halogens can be displaced with various functional groups. They can react with ammonia or primary amine to introduce an amino group, which can in turn be reacted with phosgene to produce an isocyanate group, if desired.

Reactants that are used to convert a precursor group to a functional group or to demask or deprotect a functional group, are introduced in the vapor phase, and should have vapor pressures as described above with respect to other reactants. The reaction products formed when such other reagents react in the MLD process also should have vapor pressures as just indicated. As before, excess reactants of this type are removed prior to the introduction of the next reactant, typically by drawing a high vacuum in the reaction zone, purging the chamber with a purge gas, or both. Reaction by-products are removed in the same manner, before introducing the next reactant into the reaction zone.

The foregoing are illustrative only, as a large number of other vapor phase reactants can be used in similar manner.

The process of the invention can be used to produce homopolymers (i.e., polymers of the form $-(A)_a-$), or polymers having, for example, any of the forms -(A-B)-, -(A-B-C)-, -(A-B-C-D)- $-(A-B)_x-(E-B)_y-$, $-(A)_a-(B)_b-$, or $-(A-B)_x-(C-D)_y-$, wherein A, B, C, D and E represent different repeating units and x and y are positive numbers, a and b are at least 2.

Homopolymers can be prepared in accordance with the invention using a vapor phase reactant of the fourth or fifth class described above. Reactants of that type will react with a functional group at the substrate surface or on the growing polymer chain to form a bond and extend the polymer chain. A precursor to a functional group, or a masked or protected functional group is simultaneously introduced onto the polymer chain. A subsequent reaction forms a new functional group on the polymer chain, which can react with another dose of the vapor phase reactant to further extend the chain. This process can be illustrated by the following reaction scheme:

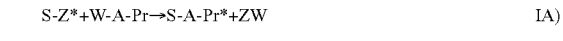

S-Z*+W-A-Pr→S-A-Pr*+ZW IA)

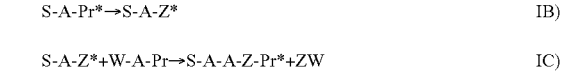

S-A-Pr*→S-A-Z* IB)

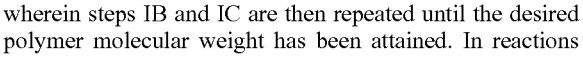

S-A-Z*+W-A-Pr→S-A-A-Z-Pr*+ZW IC)

wherein steps IB and IC are then repeated until the desired polymer molecular weight has been attained. In reactions IA-IC, S represents the substrate surface, Z and W each represents a leaving group, Pr represents a precursor to a functional group or a masked or blocked functional group which, after conversion or demasking or deblocking, forms a functional group that contains a leaving group Z, and * represents a reactive site. In step IA, the W group but not the Pr group of the W-A-Pr molecule reacts at the substrate surface to displace the Z moiety and form a bond thereto. ZW is formed as a reaction by-product, and is removed before conducting subsequent steps. In step IB, the Pr group is converted to a functional group that can react with another W-A-Pr molecule. Step IB can be conducted in various ways, depending on the nature of the W-A-Pr material. As before, any reaction by-products are removed before conducting the next step. In step IC, another W-A-Pr molecule is introduced, which reacts with the polymer chain to extend the polymer chain and again displace a Z moiety and form ZW as a reaction byproduct.

An $-(A)_a-(B)_b-$ type copolymer can be produced in analogous fashion. After a predetermined number of reaction cycles using the W-A-Pr vapor phase reactant, subsequent cycles are conducted using a reactant of the form W-B-Pr, wherein W and Pr are as defined before. The process can be extended in analogous fashion to form multiblock copolymers having repeating units of two, three, four or more types.

An -(A-B)- type polymer can be produced in a reaction sequence as follows:

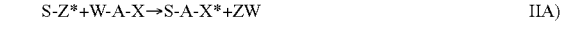

S-Z*+W-A-X→S-A-X*+ZW IIA)

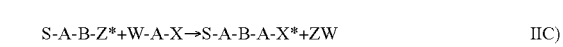

S-A-X*+Y-B-Z→S-A-B-Z*+XY IIB)

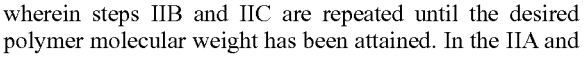

S-A-B-Z*+W-A-X→S-A-B-A-X*+ZW IIC)

wherein steps IIB and IIC are repeated until the desired polymer molecular weight has been attained. In the IIA and IIC reactions, the W chemical functionality (but not the X chemical functionality) reacts with the S-Z* or B-Z* surface species to introduce an A-X group. In the IIB reaction, the Y chemical functionality (but not the Z chemical functionality) reacts with the S-A-X* surface species to deposit B-Z* surface species.

Members of any of the first through fifth classes of reactants can be used in the reaction sequence IIA-IIC. If either or both of the W-A-X or Y-B-Z reactants used in reaction sequence IIA-IIC is of the fourth or fifth class described above, it will be necessary to introduce one or more intermediate steps to convert the precursor group or a masked or protected function group, as the case may be, to a reactive functional group.

An $-(A-B)_x-(E-B)_y-$ type copolymer can be produced in analogous fashion. After a predetermined number of reaction cycles using the W-A-X and Y-B-Z vapor phase reactant, one or more subsequent cycles are conducted substituting a reactant of the form W-E-X for the W-A-X material. Again, the concept can be extended in analogous fashion to produce more complex types of copolymers.

-(A-B-C)- type polymers can be prepared in accordance with the invention using a three-step reaction cycle that uses three different vapor phase reactants. Such a reaction scheme is illustrated as follows:

S-Z*+T-A-V→S-A-V*+ZT IIIA)

S-A-V*+W-B-X→S-A-B-X*+VW IIIB)

S-A-B-X*+Y-C-Z→S-A-B-C-Z*+XY IIIC)

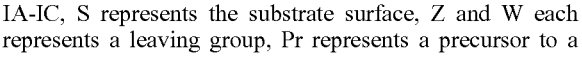

S-A-B-C-Z*+T-A-V→S-A-B-C-A-V*+ZT IIID)

wherein steps IIIB, IIIC and IIID are repeated until the desired polymer molecular weight has been attained. In reactions IIIA-D, Z, T, V, W, X, Y and Z all represent leaving groups, A, B and C represent repeating units in the polymer chain, S represents an atom or group on the surface of the substrate, and * represents the reactive site. In the IIIA and IIID reactions, the T chemical functionality (but not the V chemical functionality) reacts with the S-Z* or C-Z* surface species to deposit an A-V surface species and extend the polymer chain. In the IIIB reaction, the W chemical functionality (but not the X chemical functionality) reacts with the S-A-V* surface species to deposit a B-X* surface species. In the IIIC reaction, the Y chemical functionality (but not the Z chemical functionality) reacts with the -B-X* surface species to deposit a C-Z surface species. Members of any of the first through fifth classes of reactants can be used in the reaction sequence IIIA-IIID. If any of the T-A-V, W-B-X or Y-C-Z reactants used in reaction sequence IIIA-IIID is of the fourth or fifth class described above, it will be necessary to introduce one or more intermediate steps to convert the precursor group or a masked or protected function group, as the case may be, to a reactive functional group.

Surprisingly, it has been found that, in a reaction cycle that includes at least three different vapor phase reactants, one of the vapor phase reactants may be a material of a sixth class, which (a) has two functional groups which are similarly reactive with the growing polymer chain and (b) at least one additional functional group (which may be the same or identical to the aforementioned functional groups (a)), functional group precursor or masked or protected functional group. Among reactants of this sixth class are materials that have three or more identical functional groups (such as trimethylaluminum or triethylaluminum), or which have at least two identical functional groups plus at least one other functional group, functional group precursor or masked or blocked functional group. It has been found that reactants of this type show little tendency to stop or slow the polymerization reaction, provided that the reaction cycle includes at least three different vapor phase reactants, of which at most one is a member of the sixth class described above.

An example of a reaction sequence involving a member of the sixth class of vapor phase reacts can be illustrated as:

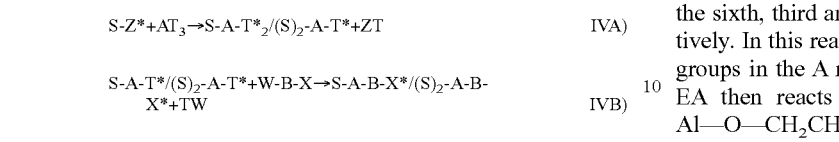

$$S\text{-}Z^*+AT_3 \rightarrow S\text{-}A\text{-}T^*_2/(S)_2\text{-}A\text{-}T^*+ZT \quad \text{IVA)}$$

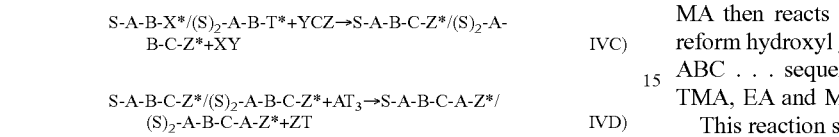

$$S\text{-}A\text{-}T^*/(S)_2\text{-}A\text{-}T^*+W\text{-}B\text{-}X \rightarrow S\text{-}A\text{-}B\text{-}X^*/(S)_2\text{-}A\text{-}B\text{-}X^*+TW \quad \text{IVB)}$$

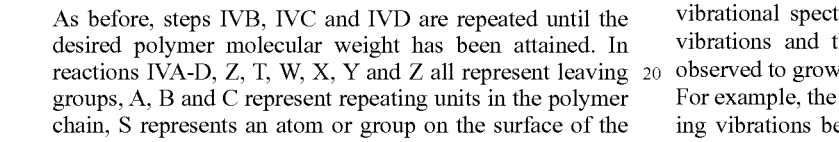

$$S\text{-}A\text{-}B\text{-}X^*/(S)_2\text{-}A\text{-}B\text{-}T^*+YCZ \rightarrow S\text{-}A\text{-}B\text{-}C\text{-}Z^*/(S)_2\text{-}A\text{-}B\text{-}C\text{-}Z^*+XY \quad \text{IVC)}$$

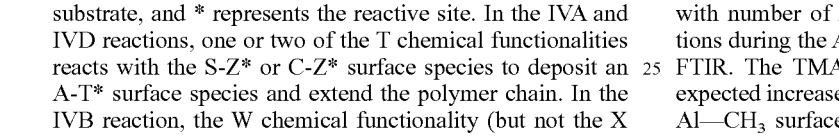

$$S\text{-}A\text{-}B\text{-}C\text{-}Z^*/(S)_2\text{-}A\text{-}B\text{-}C\text{-}Z^*+AT_3 \rightarrow S\text{-}A\text{-}B\text{-}C\text{-}A\text{-}Z^*/(S)_2\text{-}A\text{-}B\text{-}C\text{-}A\text{-}Z^*+ZT \quad \text{IVD)}$$

As before, steps IVB, IVC and IVD are repeated until the desired polymer molecular weight has been attained. In reactions IVA-D, Z, T, W, X, Y and Z all represent leaving groups, A, B and C represent repeating units in the polymer chain, S represents an atom or group on the surface of the substrate, and * represents the reactive site. In the IVA and IVD reactions, one or two of the T chemical functionalities reacts with the S-Z* or C-Z* surface species to deposit an A-T* surface species and extend the polymer chain. In the IVB reaction, the W chemical functionality (but not the X chemical functionality) reacts with the S-A-T* surface species to deposit a B-X* surface species. In the IVC reaction, the Y chemical functionality (but not the Z chemical functionality) reacts with the -B-X* surface species to deposit a C-Z* surface species.

In addition to the foregoing, other polymer types are also possible by varying the selection of vapor phase reactants and their order of addition.

An example an MLD reaction of the invention is shown schematically in FIG. 1. This reaction follows a reaction cycle as illustrated by reactions IIA-IIB above. Here, both precursors are of the second class of vapor phase reactants described above, i.e., those that engage in ring-opening reactions. In this example, 2,2-dimethoxy-1,6-diaza-2-sila-cyclooctane, a cyclic azasilane hereafter referred to as AZ, reacts with ethylene carbonate to form a polyurethane linkage. In the first step, the AZ reacts with a hydroxyl-functionalized silica surface and creates a silicon-oxygen bond. Additionally, the AZ unfolds leaving a primary amine surface species. In the second step, the ethylene carbonate reacts with the primary amine and generates a urethane linkage. The ethylene carbonate subsequently unfolds and produces a hydroxylated surface.

The reaction can be followed using FTIR. The spectrum of the starting $SiO_2$ powder shows a sharp peak at 3745 $cm^{-1}$ from O—H stretching vibrations from isolated hydroxyl groups on the surface. After the reaction of AZ, the vibrational peak associated with the isolated hydroxyl groups disappears, and the spectrum shows strong absorbances from nitrogen-hydrogen stretching (~3325 $cm^{-1}$), carbon hydrogen stretching (~2880 $cm^{-1}$), and amine deformations (~1450 $cm^{-1}$). These infrared features are expected after the reaction of AZ. Reaction of ethylene carbonate induces increases in the nitrogen hydrogen stretching and carbon hydrogen stretching peaks and a shift of the amine deformation peaks. In addition, a strong peak is observed at ~1715 $cm^{-1}$ resulting from the carboxyl group in the ethylene carbonate molecule. Increases in the nitrogen-hydrogen stretching, carbon hydrogen stretching, and amine deformations are observed again after subsequent reaction with AZ.

Figure 2:
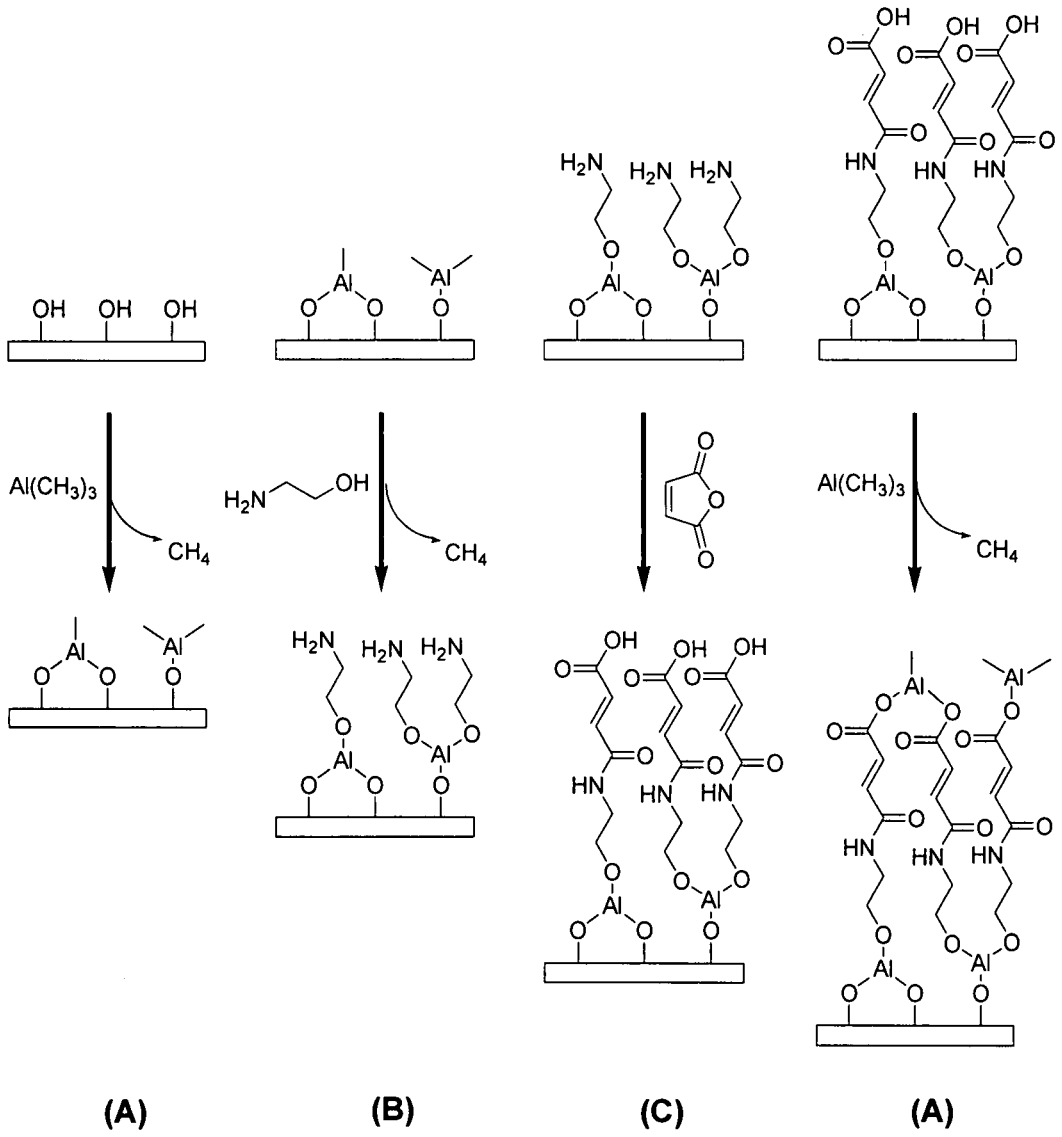
FIG. 2 is a schematic representation of a second embodiment of an MLD process of the invention.

Another example MLD reaction of the invention is shown schematically in FIG. 2. Here, a reaction cycle such as illustrated by reactions IIIA-IIID is employed. The reactants are trimethylaluminum (TMA, $Al(CH_3)_3$), ethanolamine (EA, $HO—CH_2CH_2—NH_2$) and maleic anhydride (MA, $C_4H_2O_3$). TMA, EA, and MA are vapor phase reactants of the sixth, third and second classes described above, respectively. In this reaction sequence, TMA reacts with hydroxyl groups in the A reaction to form $Al—CH_3$ surface species. EA then reacts with $Al—CH_3$ surface groups to form $Al—O—CH_2CH_2—NH_2$ surface species in the B reaction. MA then reacts with the amine $—NH_2$ surface groups to reform hydroxyl groups on the surface in the C reaction. The ABC . . . sequence can then be repeated by exposure to TMA, EA and MA.

This reaction sequence can also be monitored using FTIR vibrational spectroscopy. The C—H and N—H stretching vibrations and the amide I and amide II vibrations are observed to grow during the various number of ABC cycles. For example, the integrated absorbance of the C—H stretching vibrations between 2800-3000 $cm^{-1}$ increases linearly with number of ABC cycles. The individual surface reactions during the ABC sequence can also be monitored using FTIR. The TMA-MA FTIR difference spectra shows the expected increase in the C—H stretching vibrations from the $Al—CH_3$ surface species and the loss of O—H stretching vibrations after the A reaction. The EA-TMA FTIR difference spectrum observes the increase of N—H stretching vibrations and C—H stretching vibrations from the new $CH_2$ species after the B reaction. The MA-EA FTIR difference spectrum displays the increase in the O—H stretching vibrations and the amide I and amide II vibrations after the C reaction.

Figure 3:
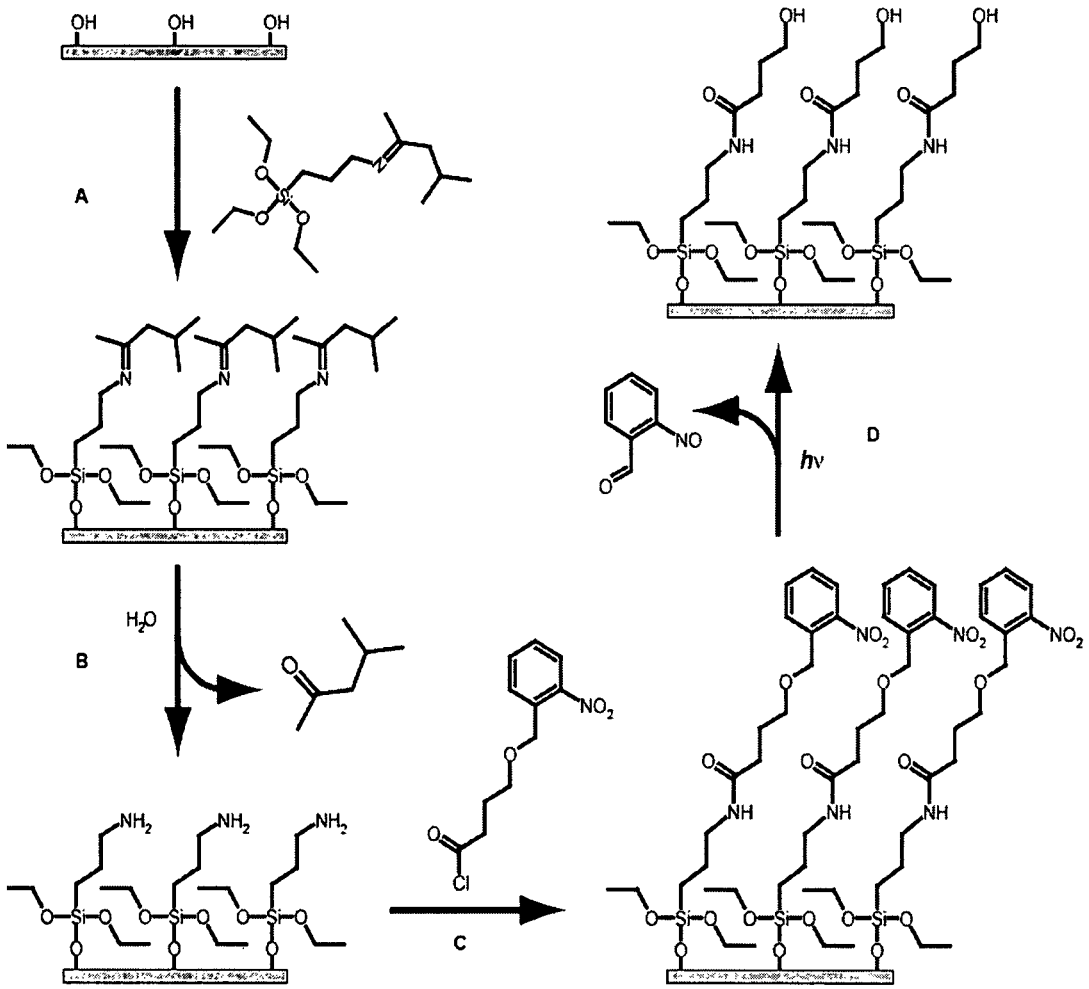
FIG. 3 is a schematic representation of a third embodiment of an MLD process of the invention.

An example of another MLD reaction is shown in FIG. 3. In this example both precursors are members of the fourth class of reactants described above, i.e., they have masked or protected functionalities. However, the masking or protecting groups on each molecule are removed by different methods. In the first step, a hydroxylated surface is exposed to 3(1,3-dimethylbutylidene)aminopropyltriethoxysilane (PS). The PS binds to the surface through a siloxane linkage. A protecting group hides the $—NH_2$ functionality until removal of the protecting group. Exposure of the PS surface to water removes the protecting group. In particular, the water reacts with the imine moiety and releases 4-methyl-2-pentanone. This reaction leaves a surface terminated with primary amine groups.

The surface can then be exposed to an acid chloride such as 1-(o-nitrobenzyl)-3-oxyheptanoyl chloride. This acid chloride precursor adds to the surface via an amide linkage. This addition yields a nitrobenzyl-protected surface. The nitrobenzyl-protection group hides an underlying hydroxyl group. The hydroxyl group is then deprotected by exposure to ultra-violet (UV) light at 320 nm. The UV light removes the nitrobenzyl group and unmasks the hidden hydroxyl chemical functionality. The reaction can then proceed with another exposure to PS.

Figure 4:
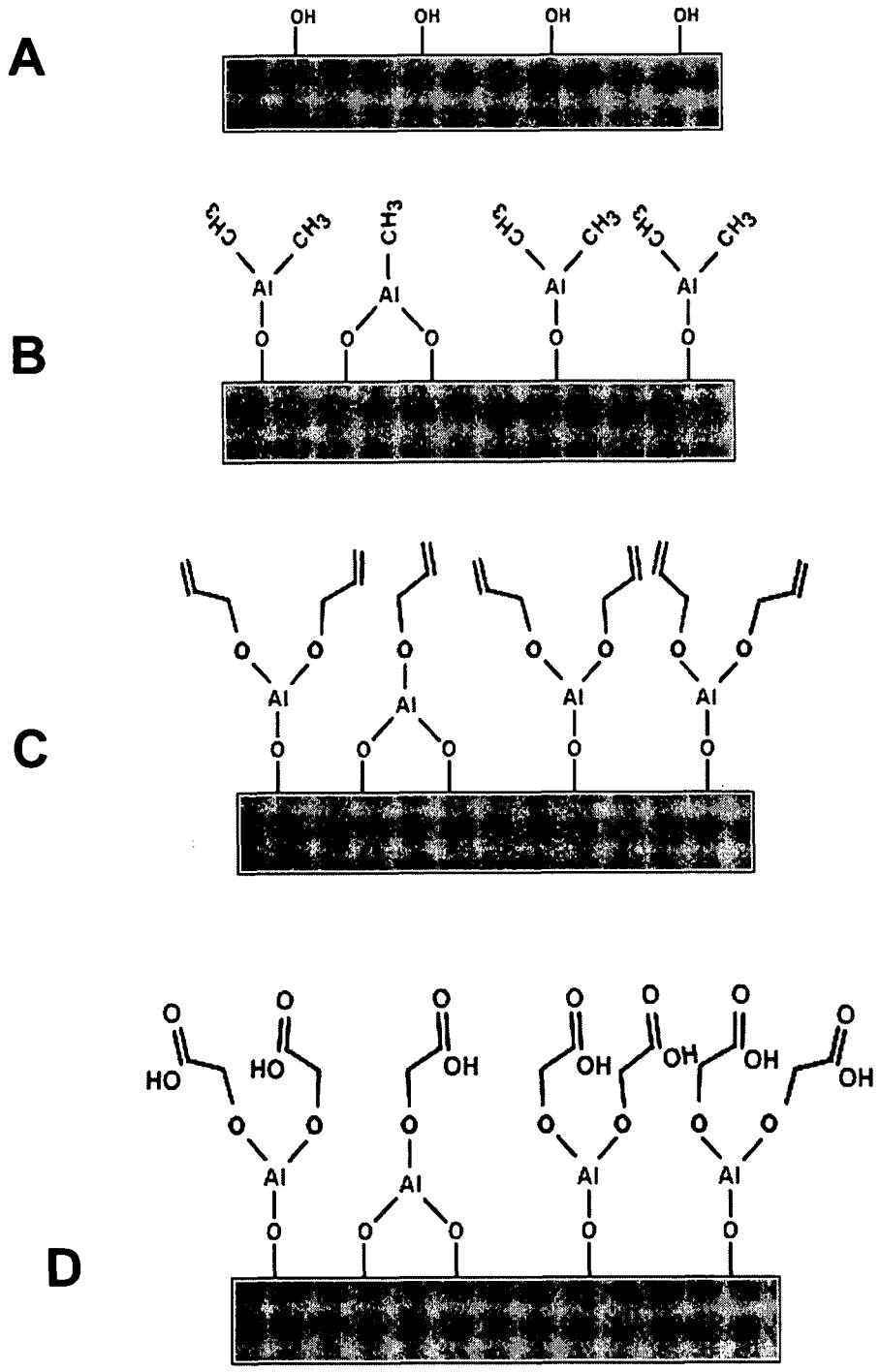
FIG. 4 is a schematic representation of an embodiment of an MLD process of the invention.

An example of an -A-B-type inorganic-organic polymer is one formed using trimethylaluminum (TMA) and 3-buten-1-ol as the precursors, as shown in FIG. 4. The 3-buten-1-ol in this example is a precursor in the fifth class that contains a hydroxyl group, which reacts with the deposited TMA precursor, and a vinyl group, which in this reaction scheme is a functional group precursor which can be converted to a functional group (a carboxyl or aldehyde) by oxidation with ozone.

The reaction begins with a hydroxylated surface as displayed in FIG. 4. Next, a layer of aluminium is deposited using TMA as shown at B in FIG. 4. 3-Buten-1-ol is then exposed to the surface as shown at C in FIG. 4. The hydroxylated end of the molecule reacts with the aluminum atom of the TMA to create an Al—O bond. This reaction displaces methane. When this reaction occurs, the double bond on the other end of the 3-buten-1-ol is orientated away from the surface. After reaction with 3-butene-1-ol, the FTIR vibrational spectrum displays a characteristic peak at 3084 $cm^{-1}$, corresponding to the C—H stretching vibration on the terminating double bond. Another peak corresponding to the carbon-carbon double bond stretch is observed at 1642 $cm^{-1}$.

The terminal double bond is activated by exposure to ozone to form a carboxylic acid, as shown at D in FIG. 4. As the double bonds react and carboxylic acid groups form, the peaks at 3084 and 1642 $cm^{-1}$ disappear, and new vibrational features are produced at ~1550 $cm^{-1}$.

The hydroxyl of the carboxylic acid is then ready to be reacted once again with TMA. As before, this reaction can be followed by FTIR. The methyl groups introduced by the TMA are indicated by the methyl carbon-hydrogen deformation at 1217 $cm^{-1}$ and the methyl carbon-hydrogen stretch is at 2933 $cm^{-1}$. The Al—O stretch is also clearly observed in the difference spectrum as the broad peak from 906-833 $cm^{-1}$. An O—H stretching vibration from the hydroxylated substrate surface signal at 3689 $cm^{-1}$ decreases as TMA deposits on the surface.

B. Organic-Inorganic Nanocomposites

In another aspect of the invention, MLD approaches for polymer deposition can be combined with ALD methods for inorganic material growth to fabricate organic-inorganic hybrid materials. These hybrid materials are similar to block or multiblock copolymers in which blocks of the inorganic material are separated by blocks of the organic polymer. These are formed by depositing multiple layers of the inorganic layer followed by depositing multiple layer of the organic material. The mechanical, thermal, electrical, optical and chemical properties of the composite film can be tuned by the assembly of different organic/inorganic composition and different relative thicknesses of the organic and inorganic layers.

Organic reactants as described above can be used in conjunction with traditional ALD reactants to form inorganic-organic nanocomposites. Examples of such traditional ALD reactants include compounds such as trimethylaluminum (to form $Al_2O_3$), hafnium tetrachloride (to form $HfO_2$), silicon tetrachloride (to form $SiO_2$), titanium tetrachloride (to form $TiO_2$), diethyl zinc (to form ZnO), tetra(dimethylamino)zirconium (to form $ZrO_2$), and the like. The organic reactant must be capable of reacting with a functional group on the surface of the inorganic layer, and also must provide (directly or indirectly) a functional group with which the inorganic reactant can react and form a covalent bond on the surface of the organic layer.

One specific organic-inorganic composite of this type is produced by depositing alternate layers of an ABC polymer and alumina. This ABC polymer layer is prepared using trimethylaluminum (TMA, $Al(CH_3)_3$), ethanolamine (EA, $HO—CH_2CH_2—NH_2$) and maleic anhydride (MA, $C_4H_2O_3$) as shown in FIG. 2. After depositing a layer of the ABC polymer, an alumina layers are deposited using sequential exposures of trimethylaluminum (TMA) and $H_2O$. After the alumina layer is deposited, another layer of the ABC polymer and be further deposited. Another layer of alumina can then be further deposited if desired to form a ABC polymer/$Al_2O_3$ multilayer.

As before, the formation of these layers can be monitored using FTIR spectroscopy. Absorbance from $Al_2O_3$ bulk vibrational features appears in the FTIR spectrum over a broad range from 600-1000 $cm^{-1}$. The absorbance in this region increases progressively with the growth of each $Al_2O_3$ ALD layer. The formation of the ABC polymer is revealed by C—H stretching vibrational features at 2800-3000 $cm^{-1}$ and amide vibrations at 1650 and 1560 $cm^{-1}$. The absorbances in these regions increase progressively with the growth of each ABC polymer layer.

Hybrid multilayer structures, such as this ABC polymer/$Al_2O_3$ nanolaminate, may be useful as gas diffusion barriers to prevent the permeability of $H_2O$ and $O_2$. High performance gas diffusion barriers are critical for the development of flexible organic light emitting diodes. Organic-inorganic composites may also display very desirable mechanical properties. The inorganic layer is hard and the organic layer is flexible. Organic-inorganic multilayers occur in the nacreous layer of the mollusk shell and are among the strongest structures in nature. The organic-inorganic composites also provide for the tuning of polymer properties. The relative fraction of the two phases will allow polymer properties to be adjusted as expected from the "rule of mixtures".

C. Reactor Design

This invention is in some respects a reaction vessel for conducting an MLD reaction, wherein the reaction vessel includes a reaction zone, multiple inlets for separately introducing two or more MLD precursors to the reaction zone, multiple outlets for separately removing excess MLD precursors from the reaction zone, and means for heating the walls of the reaction zone.

Figure 5:
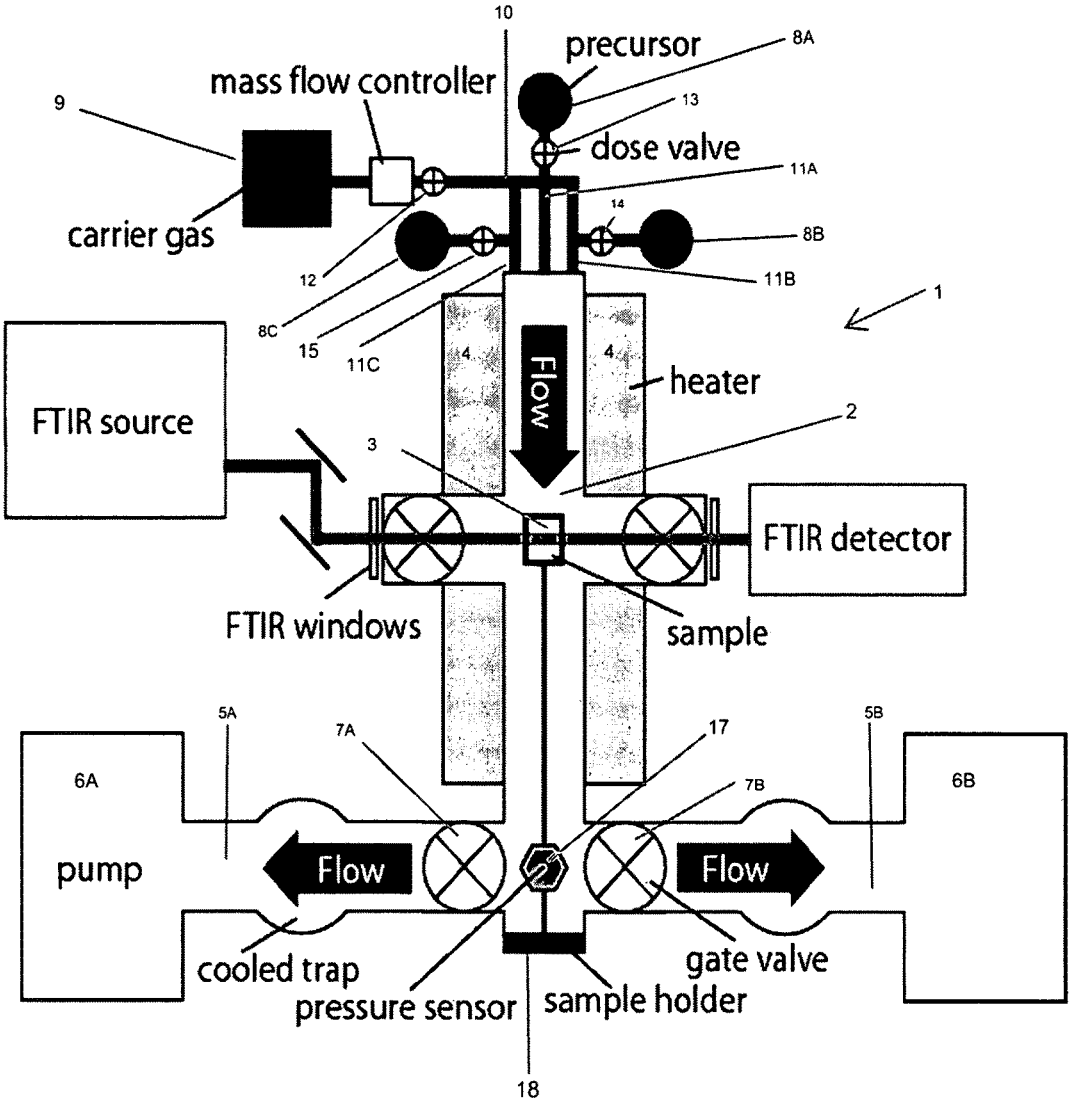
FIG. 5 is a schematic diagram of a reaction vessel in accordance with the invention.

An embodiment of such a reaction vessel is shown in FIG. 5. Reactor 1 includes reaction zone 2 which is encompassed by heater 4. Heater 4 keeps the walls of reaction zone 2 hot enough to prevent condensation of the reactants on the walls or other internal surfaces of the reaction zone. Other internal surfaces, such as those of the various conduits and outlets described below, should also be kept hot enough to prevent condensation. Optional pressure sensor 17 can be positioned within reaction zone 2.

The substrate to be coated can be held, for example at position 3 (where it can be interrogated by optional FTIR apparatus, as shown), or in position 18. As shown in FIG. 5, the reaction vessel includes duplicate pump/reactant removal systems. Outlet 5A provides an egress for one excess reactant. Pump 6A pulls a vacuum on outlet 5A to pull an excess reactant from the reaction vessel. Outlet 5A is equipped with a valve 7A, which allows outlet 5A to be opened or closed. Similarly, outlet 5B provides a second egress for a second excess reactant. Pump 6B and gate valve 7B operate analogously to pump 6A and valve 7A. Each pump line preferably is equipped with a cooled vacuum trap for removal of the precursor from the line before the precursor enters the pump. Valves 7A and 7B and pumps 6A and 6B are operated in such a manner that excess reactant of one type is withdrawn through outlet 5A and excess reactant of another type is withdrawn through outlet 5B. During reaction, the pump lines are alternately opened and closed in order that only one precursor is pumped down each line. In this manner, the polymerization reactions are limited to the surfaces of the reactor only. This separation of the pumps helps to keep the polymer precursors from reacting in the pump lines and pumps and eventually causing pump failure and reactor contamination.

In addition to directing the flow of the polymer precursors to separate pumps, the gate valves 7A and 7B also allow the reactor to operate in both flow and static modes. For higher vapor pressure and quickly reacting precursors, the gate valve is left open while the precursor is exposed to the substrate. The precursor then flows through the reactor and is pumped out of the chamber immediately. For lower vapor pressure and more slowly reacting precursors, the gate valve is closed while the precursor is exposed to the substrate. This gate valve closure creates a sealed container in which the precursor can react with the surfaces. The gate valve is then opened and the precursor is pumped out. This design adds flexibility for dealing with the reaction conditions required by precursors with very different vapor pressures and reaction kinetics.

Reactants are supplied from separate sources 8A, 8B and 8C, which are in fluid communication with reaction zone 2 through conduits 11A, 11B and 11C, respectively. Each of the conduits is controlled through values 13, 14 and 15, respectively, to allow the various precursors into the reaction zone individually.

A purge gas can be supplied from container 9 through gate value 12 into conduit 10, from which it can flow through any of conduits 11A, 11B or 11C. The ability to purge the chamber and precursor lines with a carrier gas is also extremely helpful in decreasing the reaction cycle times and avoiding CVD conditions. The purge gas is usually an inert gas such as $N_2$ or Ar. This purge gas acts to draw by entrainment the remaining precursor through and out of the reaction chamber before the next precursor is deposited. The purge gas can be controlled by a mass flow controller or can be easily controlled using a valve. The purge gas is turned off during static deposition or is left flowing during flow deposition. The presence of valve 12 provided the ability to operate reactor in either flow mode with carrier gas or static mode.

What is claimed is:

1. A molecular layer deposition process for forming, under appropriate reaction conditions, a layer of an organic polymer or organic-inorganic polymer onto a first hydroxyl-functionalized surface while preventing chain termination and cross-linking, comprising:

reacting a cyclic azasilane comprising 2,2-dimethoxy-1,6-diaza-2-silacyclooctane with a surface hydroxyl on the first hydroxyl-functionalized surface;

allowing a ring of the 2,2-dimethoxy-1,6-diaza-2-silacyclooctane to open and form a silicon-oxygen bond to the first hydroxyl-functionalized surface;

allowing the opened ring of the 2,2-dimethoxy-1,6-diaza-2-silacyclooctane to unfold, thereby leaving a primary amine surface species;

allowing ethylene carbonate to react with the primary amine surface species to generate a urethane linkage to the primary amine surface species, and unfold, thereby forming the layer of the organic polymer or organic-inorganic polymer having a second hydroxyl-functionalized surface.

2. The molecular layer deposition process of claim 1, wherein the first hydroxyl-functionalized surface and the second hydroxyl-functionalized surface comprise silica.

3. A molecular layer deposition process for forming a layer of an organic polymer or organic-inorganic polymer onto a first hydroxyl-functionalized surface while preventing chain termination, comprising, under appropriate reaction conditions the steps of:

allowing trimethylaluminum in the vapor phase to react with hydroxyl surface groups on the first hydroxyl-functionalized surface, thereby forming an Al—$CH_3$ surface species;

allowing ethanolamine in the vapor phase to react with the Al—$CH_3$ surface species, thereby forming an Al—O—$CH_2CH_2$—$NH_2$ surface species; and allowing maleic anhydride in the vapor phase to react with the amine, —$NH_2$, groups on the Al—O—$CH_2CH_2$—$NH_2$ surface species, thereby forming the layer of the organic polymer or organic-inorganic polymer having a second hydroxyl-functionalized surface.

4. A molecular layer deposition process for forming a layer of an organic polymer or organic-inorganic polymer onto a first hydroxyl-functionalized surface while preventing chain termination and cross-linking, comprising, under appropriate reaction conditions the steps of:

contacting the first hydroxyl-functionalized surface with 3(1,3-dimethylbutylidene)aminopropyltriethoxysilane (PS) wherein a protecting group hides the —$NH_2$ functionality;

allowing the PS to form a siloxane linkage to the hydroxylated surface;

contacting the PS surface with water;

allowing the water to react with the imine moiety on the PS, thereby removing the protecting group, releasing 4-methyl-2-pentanone, and forming a surface terminated with primary amine groups;

exposing the surface to an acid chloride or an acid chloride precursor, which bonds to the surface with an amide linkage, the amide linkage producing a nitrobenzyl-protected surface wherein the surface nitrobenzyl-protection group hides an underlying hydroxyl group; and exposing the surface nitrobenzyl-protection group to ultra-violet light at an appropriate wavelength and for a sufficient period of time to remove the nitrobenzyl-protection group and unmask the underlying hydroxyl group, thereby forming the layer of an organic polymer or organic-inorganic polymer having a second hydroxyl-functionalized surface.

* * * * *